United States Patent [19]

Edwards et al.

[11] Patent Number: 4,802,412

[45] Date of Patent: Feb. 7, 1989

[54] IMPRINTER APPARATUS WITH CHANGEABLE CASSETTE IMPRINT ROLLER STRUCTURE

[75] Inventors: David G. Edwards, Dublin; Gerard Finlay, Naven; David J. Boyle, Leixlip, all of Ireland; Clyde C. Heasly, Jr., Arlington, Va.; Joseph M. Walsh, Raheny, Ireland; Ralph J. Poling, Walkersville, Md.

[73] Assignee: Security Imprinter Corporation, Walkersville, Md.

[21] Appl. No.: 46,557

[22] Filed: May 6, 1987

Related U.S. Application Data

[63] Continuation-in-part of Ser. No. 834,633, Feb. 28, 1986, abandoned.

[30] Foreign Application Priority Data

Jun. 4, 1985 [IE] Ireland ..... 1376/85
Nov. 21, 1985 [IE] Ireland ..... 2918/85

[51] Int. Cl.[4] ..... B41F 3/04
[52] U.S. Cl. ..... 101/269
[58] Field of Search ..... 101/269, 56

[56] References Cited

U.S. PATENT DOCUMENTS

| | | | |
|---|---|---|---|
| 671,729 | 4/1901 | Lee et al. | 101/269 |
| 2,319,961 | 5/1943 | Vandercook | 101/270 |
| 2,598,161 | 5/1952 | Gruver | 101/269 |
| 3,138,091 | 6/1964 | Maul | 101/269 |
| 3,269,307 | 8/1966 | Bell et al. | 101/269 |
| 3,417,691 | 12/1968 | Kubovy | 101/269 |
| 3,577,917 | 5/1971 | Nantz | 101/56 |
| 3,633,505 | 1/1972 | Ferrari | 101/269 |
| 3,800,700 | 4/1974 | McInnis et al. | 101/269 |
| 3,826,190 | 7/1974 | Zofchak | 101/56 |
| 3,838,640 | 10/1974 | Correll | 101/269 |
| 4,200,402 | 4/1980 | Rix | 101/269 |
| 4,418,619 | 12/1983 | Diel | 101/269 |
| 4,423,679 | 1/1984 | Maul | 101/269 |
| 4,437,404 | 3/1984 | Barbour | 101/269 |

FOREIGN PATENT DOCUMENTS

| | | | |
|---|---|---|---|
| 233283 | 4/1911 | Fed. Rep. of Germany | 101/269 |
| 402061 | 9/1924 | Fed. Rep. of Germany | 101/269 |
| 823082 | 10/1937 | France | 101/269 |
| 2467079 | 5/1981 | France | 101/269 |
| 2537674 | 6/1984 | France | 384/909 |
| 2025848 | 1/1980 | United Kingdom | 101/269 |
| 2155403 | 8/1985 | United Kingdom | 101/269 |

*Primary Examiner*—Clifford D. Crowder
*Attorney, Agent, or Firm*—Mason, Fenwick & Lawrence

[57] ABSTRACT

Electric motor driven imprinter apparatus for imprinting characters from a character imprint source member onto document sheets or the like, including a housing having a driven roller moved back and forth transversely across an imprint station, a horizontally slidable carrier block member and a changeable cassette carried by the block member having a changeable vertically slidable roller block member and a roller rotatably carried thereby. A pair of spaced apart rotatable sprockets and an endless drive chain having a spud projecting therefrom and provided for driving the carrier block member and roller block member back and forth through advance and return strokes spanning the imprint station. The roller block support structure is movable from an imprint position to a release position for removable and replacement of the roller block member and roller, and a carrier member is hinged for pivotal movement relative to the casing and has a recess for receiving the imprint source member and a pocket for document sheets.

20 Claims, 11 Drawing Sheets

167
165
161
166
160
164
163
61
59
67

160
67
160
69
63
64

80
100
78
90
97
103
146
131
130
132
133
135
137
110
107
105
124
123
125
121
122
125
87
84
90

IMPRINTER APPARATUS WITH CHANGEABLE CASSETTE IMPRINT ROLLER STRUCTURE

PRIOR RELATED APPLICATIONS

This application is a continuation-in-part of earlier U.S. application Ser. No. 834,633, filed Feb. 28, 1986, now abandoned.

BACKGROUND AND OBJECTS OF THE INVENTION

The present invention relates to imprinter apparatus, and in particular apparatus for imprinting characters from a credit card or the like onto a document.

According to the invention, there is provided imprinter apparatus for imprinting a character onto a sheet of material, the apparatus comprising means to receive and retain the character, means to receive and retain the sheet of material adjacent the character, imprinter means movable across the sheet of material to press the material against the character to cause the imprint, and means to move the imprint means. Preferably, the imprint means is a roller means.

In one embodiment of the invention, the means to move the roller means is provided by a chain or a drive belt around two spaced-apart sprockets or pulleys, one of the sprockets or pulleys being driven by a motor.

In an embodiment of the invention, a spud extends from one link of the chain to engage the roller means for movement thereof. Preferably, the spud engages an elongated slot in the roller means to accommodate lateral movement of the spud as it passes around the sprockets.

The roller means may be releasably mounted to the apparatus and releasably engage at least one track extending substantially parallel to the chain. Preferably, a pair of spaced-apart tracks are provided, one on each side of the drive and return sides of the chain. The tracks are of circular cross section, and the roller means engages the tracks by grooves of substantially semi-circular cross section corresponding to the diameter of the tracks. In one particular embodiment of the invention, the grooves in cross section are slightly greater than a semi-circle to provide grip on the tracks.

The roller means may be supported by a block in which a roller is rotatably mounted, a portion of the periphery of the roller extending beyond the block, the roller serving an inked roller.

The means to receive the character is provided by a pivotal carrier member, pivotal from a position spaced-apart from the roller to a position adjacent the roller. In an embodiment of the invention, the pivotal member has a substantially flat surface which is movable into contact with the roller. A card receiving portion to receive a credit card on which the characters are embossed, is provided. Additionally, other characters are provided in the carrier member, the latter characters being details of the merchant using the apparatus.

The means to receive a document may be provided by a pair of spaced-apart guide plates, which engage each end of the document, and a lower guide plate extending between the end plates which engages one side of the document.

Locking means to lock the carrier member in engagement with the roller is provided, together with release means for releasing the carrier member, the release means being activated by a second spud on the drive chain after the roller means has completed a pass across the carrier member.

An override release means is provided in the carrier member, said override release means being engagable with the locking means to disengage the locking means in the event of a jam or the like.

Preferably, the override release means comprises a linkage mounted in the carrier member and engagable with the locking means. The locking means is provided by an elongated bar extending substantially parallel to the pivot axis of the carrier member and spaced-apart from the pivot axis, said locking bar being engagable with at least one member extending outwardly from the carrier member.

A further feature of the invention includes means to activate the electric motor formed by a microswitch, and preferably, a linkage member connected to the microswitch with a member extending from the carrier member so that as the carrier member is pivoted to engage against the roller means, the microswitch is activated, thereby activating the motor. A further feature of the invention includes a spud extending from one link of the chain to release the activating linkage after the roller means has returned to its original position after making one pass, thus deactivating the motor.

Additionally, the invention provides a roller means for use in the apparatus, the roller means being adapted for releasable mounting in the apparatus.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 4:
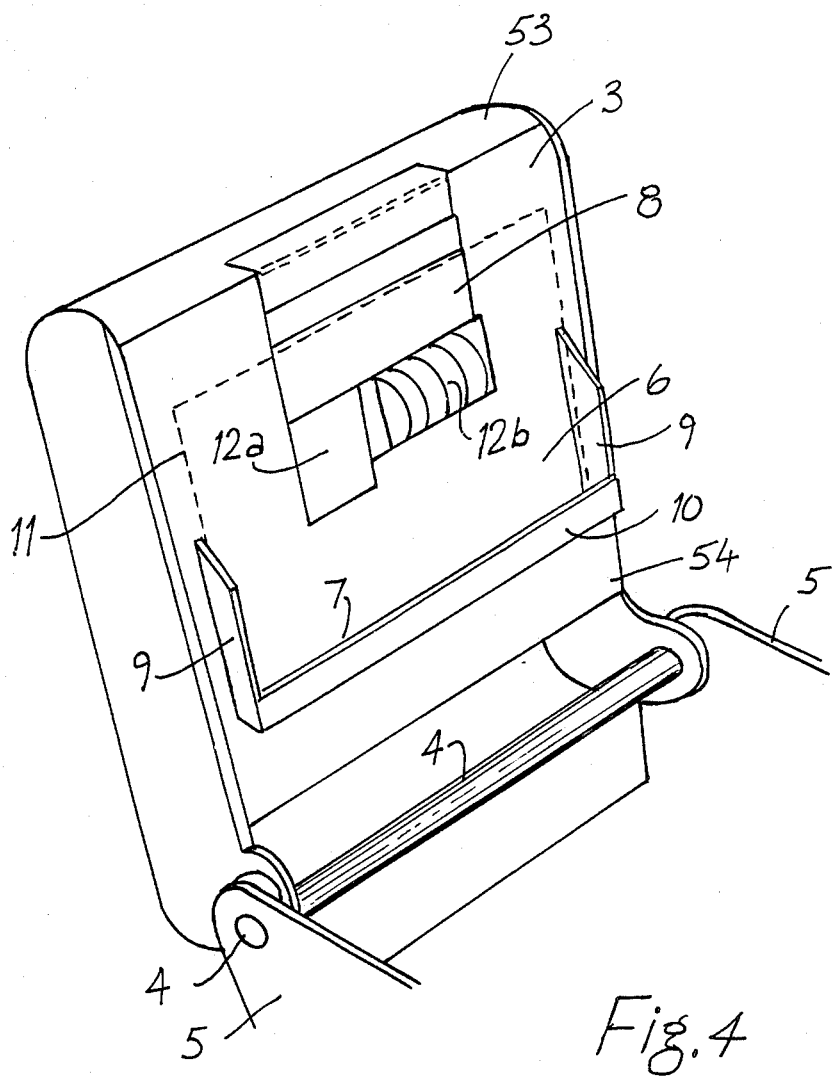
FIG. 4 is a fragmentary perspective view of the carrier member portion of the apparatus of FIG. 1.

Referring to the drawings, there is illustrated imprinter apparatus according to the invention, indicated generally by the reference numeral 1 for imprinting characters onto a sheet of material, in this case, embossed characters on a credit card onto a document 11, shown in FIG. 4. The apparatus 1 comprises a housing section 2. A means to receive a credit card 8C and document 11 is provided by a carrier member 3 pivotally mounted on a pivot shaft 4 extending between side walls 5 of the housing section 2. The carrier member 3 has a substantially flat surface 6 in which a recess 8 is provided to receive the credit card 8C. A pocket 7 provided by a pair of side members 9 and a cross member 10 retain the document 11 on top of the credit card, illustrated by broken lines in FIG. 4. The carrier member 3, at the surface 6, also carries other permanently mounted characters, such as provided on the character wheels 12*a*, which are set for example to identify the merchant where the transaction is taking place and a dater character means 12*b*.

Figure 1:
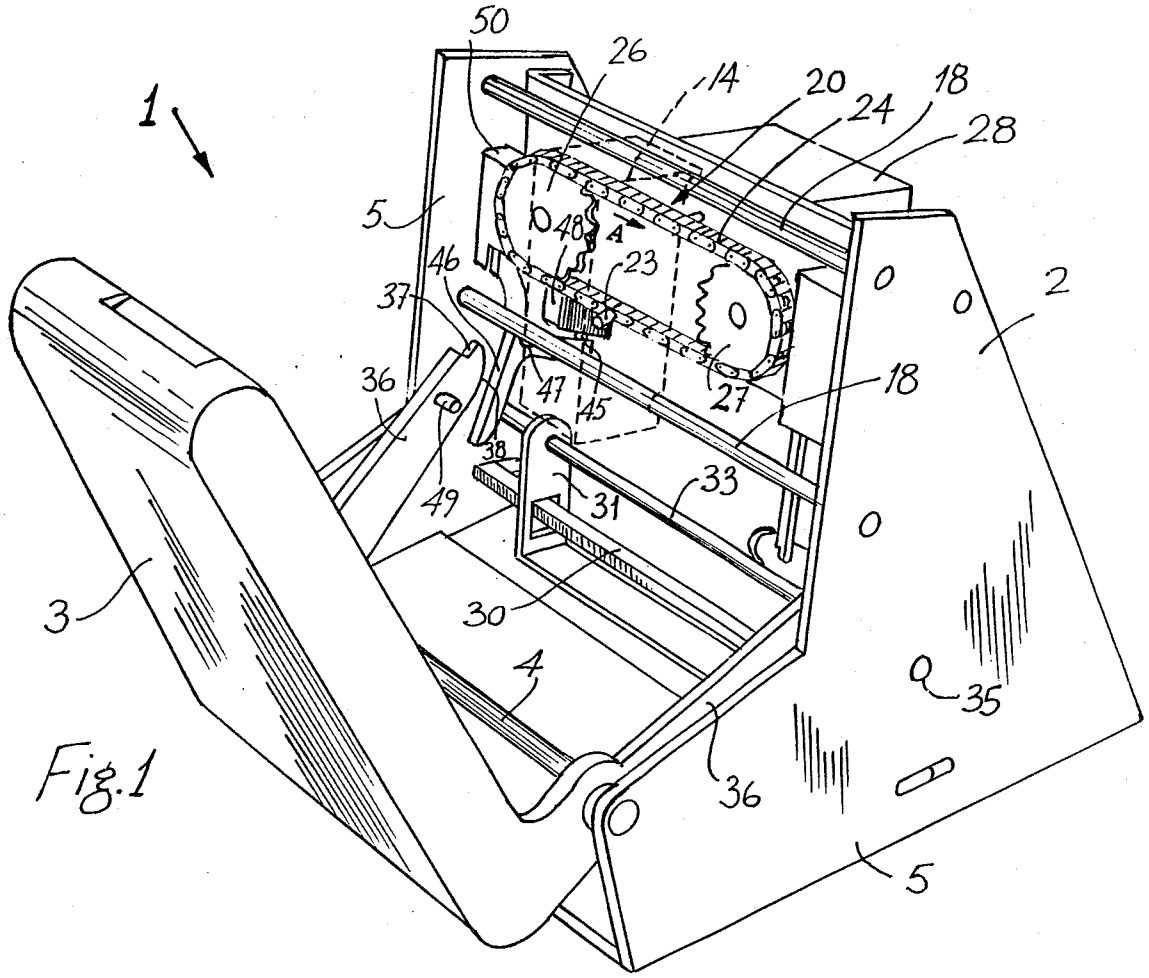
FIG. 1 is a perspective view of imprinter apparatus according to the invention.
Figure 2:
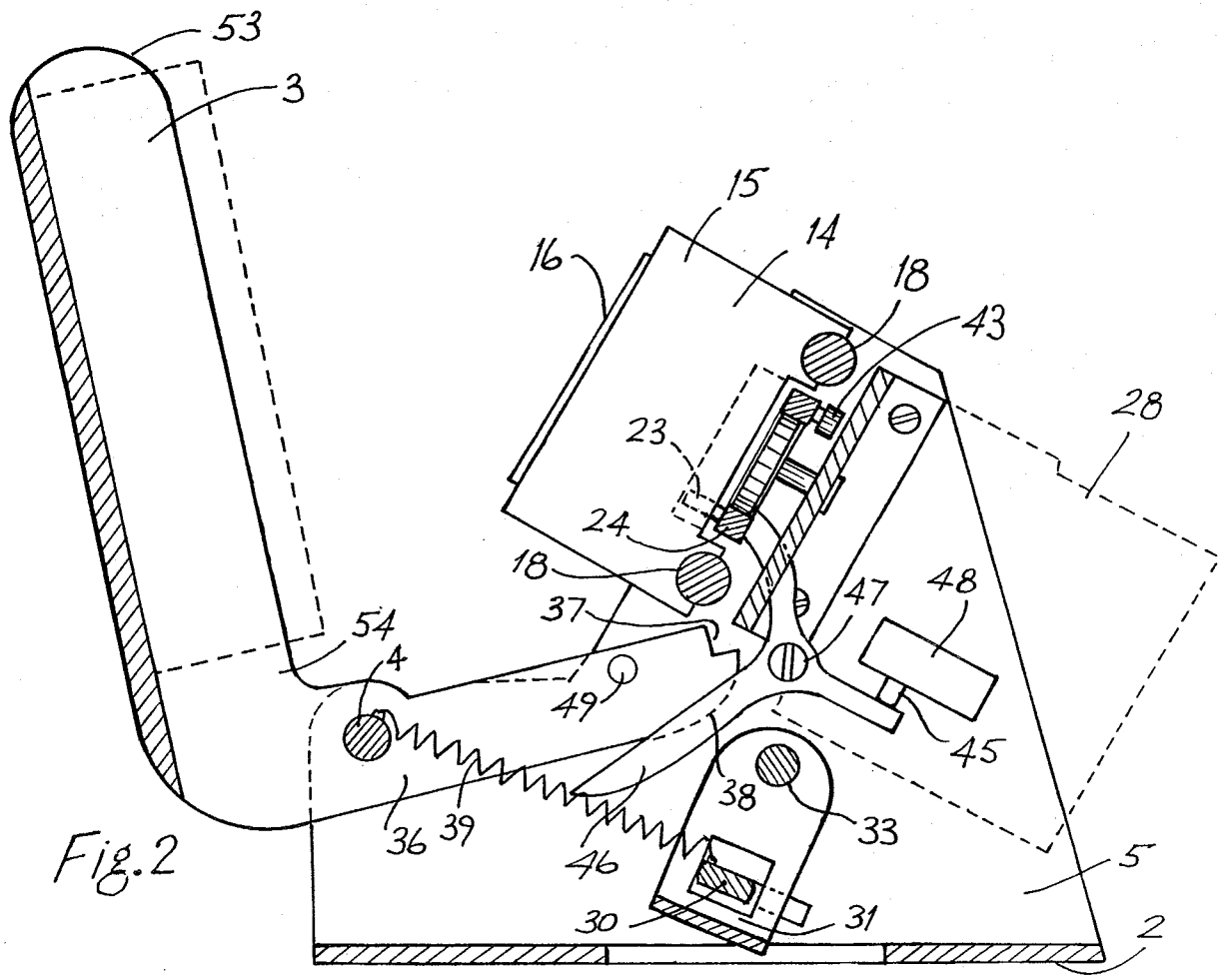
FIG. 2 is a side elevational view of the apparatus of FIG. 1, shown in the open position, with parts broken away.
Figure 3:
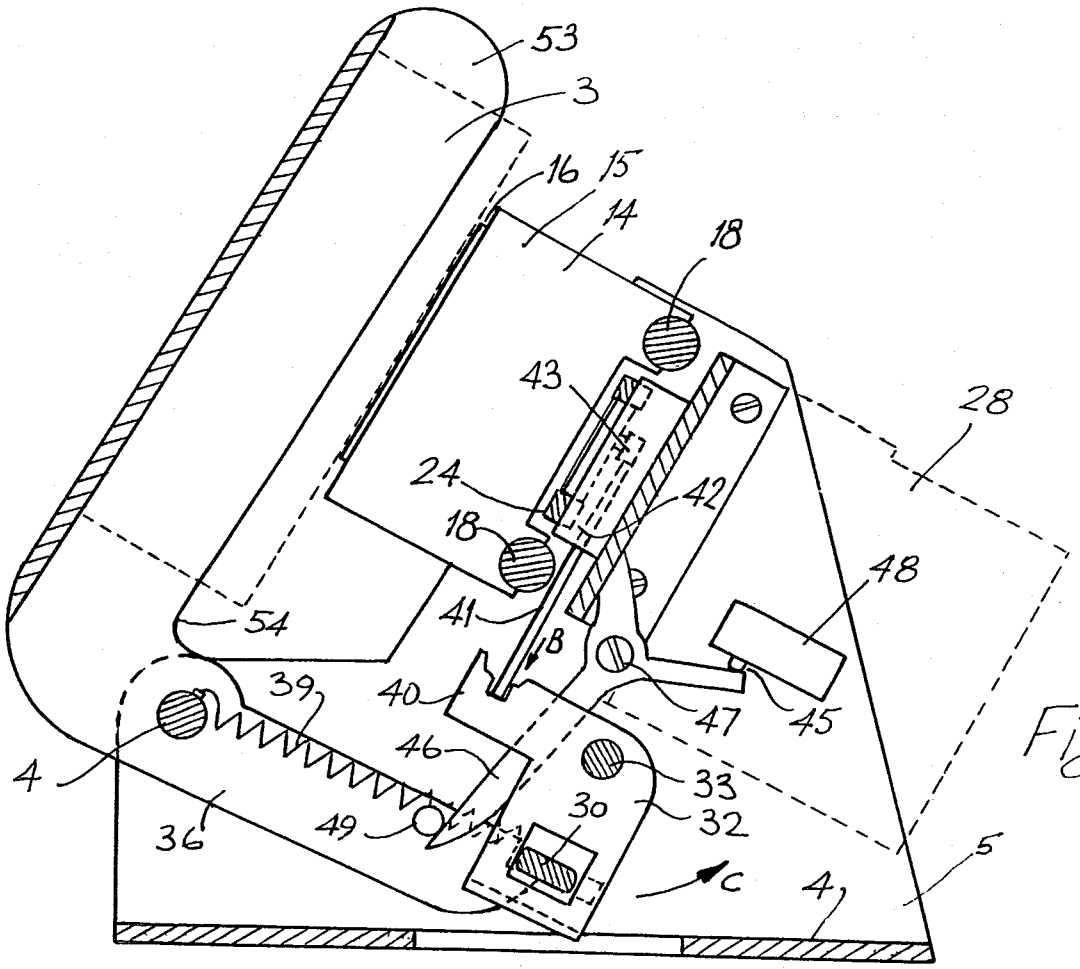
FIG. 3 is a side elevational view of the apparatus similar to FIG. 2, but shown in the closed position.
Figure 6:
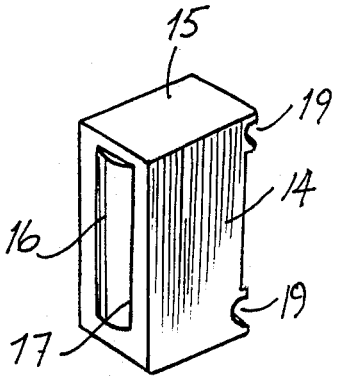
FIG. 6 is a perspective view of the block member mounting the inked roller of the apparatus of FIG. 1.
Figure 7:
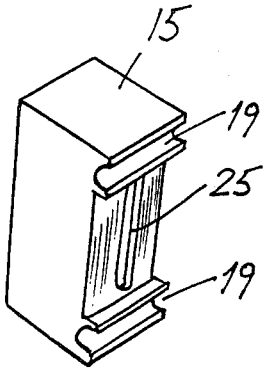
FIG. 7 is a perspective view of the block member of FIG. 6 from a different direction.

The carrier member 3 is pivotal from an open position illustrated in FIGS. 1 and 2 to a closed position illustrated in FIG. 3 where the credit card 8C and document 11 are brought into pressure contact with a movable imprinter means comprising a roller means 14. In this case, the roller means 14 is releasably mounted in the apparatus, as will be described below. The roller means comprises a slide block member 15 in which is rotatably mounted an inked roller 16. As can be seen in FIG. 6, a portion of the roller 16 projects through a front slot 17 in the block member 15 of the roller means 14.

Referring now to FIG. 1 in particular, the roller slide block 15 is slidable on a pair of spaced-apart tracks comprising guide rods 18 of circular cross section extending between the side walls 5. A pair of substantially semi-circular grooves 19 in the roller slide block 15 releasably engage the tracks 18. In this particular case, the cross section of the grooves 19 is just slightly greater than semi-circular so that the grooves engage the tracks 18 with a slight snap-on action. The roller block 15 is driven from one side, namely, the left-hand side of the apparatus of FIG. 1, to the right-hand side, and returned again to the left-hand side, by a drive means which in this case comprised a chain drive mechanism, indicated generally by the reference numeral 20. On the pass from the left-hand side to the right-hand side, the roller bears on the document 11 and card 8C and imprinting takes place, and on the return pass from the right-hand side to the left-hand side, the carrier member 3 is released from the roller into the open position of FIG. 1.

The chain drive mechanism 20 comprises a chain 24 mounted around a pair of sprockets 26 and 27. The sprocket 26 is driven by an electric motor 28, and the sprocket 27 is an idler sprocket. A drive spud 23 on one link of the chain 24 of the chain drive mechanism 20 engages a slot 25 in the roller slide block 15. As the chain moves in the direction of the arrow A of FIG. 1 from the left-hand side of the right-hand side with the drive spud 23 on the top portion of the chain, the roller slide block 15 is driven from the left to the right. When the spud 23 is on the lower portion of the chain, the block 15 is returned. The slot 25 accommodates lateral movement of the spud 23 as the chain passes around the sprockets between each pass.

The carrier member 3 is retained in the closed position of FIG. 3 by lock means which in this case is provided by a locking bar 30. The locking bar 30 is loosely mounted in a pair of spaced-apart cam brackets 31 and 32, which are fast on a pivot shaft 33. The pivot shaft 33 is pivoted in holes 35 in the side walls 5. A pair of lock members 36 extend from the carrier member 3 and engage the locking bar 30 by means of latch formations comprising recesses 37 to retain the carrier member 3 in the closed position. As can be seen, the ends of the lock members 36 are radiused at 38 to define cam surfaces so that as the carrier member 3 is closed, the lock members 36 pivot the bar 30 clear. A tension spring 39 extending between the locking bar 30 and the pivot shaft 4 biases the locking bar 30 to engage the recesses 37. In the locked position, the roller slide block 15 is over to the left-hand side of the apparatus of FIG. 1.

A release means to release the locking bar 30 from the recesses 37 is provided by a trip release lever 41. The release lever 41 is slidable in a block 42 and, as will be apparent from FIG. 3, engages a crank shaped portion 40 on the bracket 32. A trip release spud 43 on the rear of the chain 24 comes into engagement with the trip lever 41, as it passes around the sprocket 27, and thus depresses the trip lever 41 downwardly in the direction of the arrow B in FIG. 3. This in turn pivots the bracket 32 about the pivot bar 33 in the direction of the arrow C which in turn pushes the locking bar 30 to disengage it from the recesses 37 of the lock members 36 from bar 30. This releases the carrier member 3 to pivot outwardly into the open position under spring biasing (not shown). Thus, once the roller slide block 15 has completed its pass from the left-hand side to the right-hand side of the apparatus, the carrier member opens.

Figure 5:
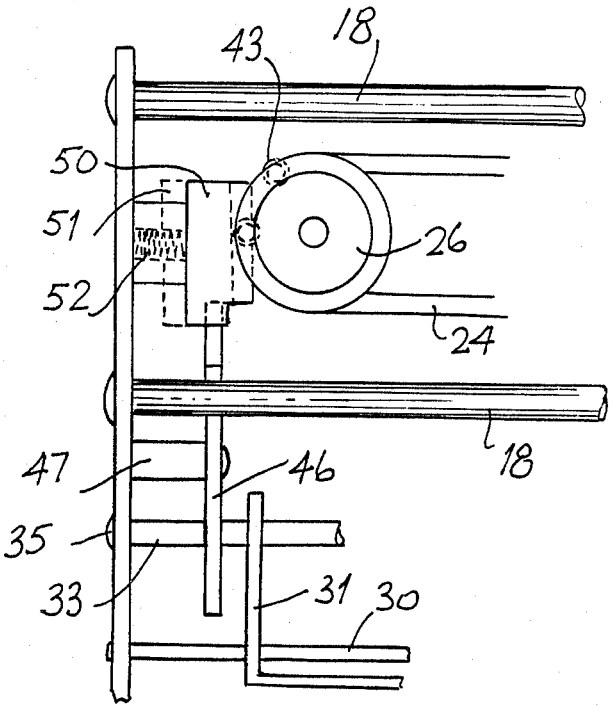
FIG. 5 is an elevational view of another portion of the apparatus of FIG. 1.

Switch operating means to operate the motor 28 comprises a crank shaped link member 46 pivotally supported on one of the side walls 5 by a pivot pin 47 bears on a plunger 45 of a microswitch 48 which controls the circuit which activates and deactivates the electric motor 28. A lug 49 on one of the locking members 36 of the carrier member 3 bears on the link member 46 on closure of the carrier member 3, thereby depressing the microswitch plunger 45 to activate the motor. Thus, on closure of the carrier member 3 the motor 28 is activated and the roller slide block 15 makes it first pass from the left-hand side to the right-hand side. On being moved into the active position by the lug 49, the link member 46 is retained in this position by a locking clip 50 slidable in a block 51 (see FIG. 5) and spring biased out from the side wall 5 by a compression spring 52. The second spud 43 on passing around the sprocket 26 trips the locking clip 50 out of engagement with the link member 46, thereby releasing the link member 46 and deactivating the microswitch, and in turn the electric motor 28. In this way the motor 28 is retained activated until the roller slide block 15 has completed its return pass back to the left-hand side of the apparatus of FIG. 1.

Although not illustrated, an override release linkage is provided in the carrier member to release the carrier member from the closed position in the event of a jam in the apparatus. Such override release linkage will be well known to those skilled in the art. It is envisaged that a member will extend from the top portion 53 of the carrier member for activation by the thumb of the user, and would be pivoted in the carrier member to activate a lower linkage extending from the lower portion 54 of the carrier member 3 to extend inwardly into the apparatus to engage the locking bar 30. Thus, by activating the linkage the member extending to engage the bar 30 would pivot the bar 30 in the direction of the arrow C as illustrated in FIG. 3, thereby releasing the carrier member.

In use, a credit card 8C is placed in the recess 8 with the carrier member 3 open. A document 11 is placed in the pocket 7 overlaying the credit card 3C. The carrier member 3 is then closed into the position of FIG. 3. On being closed, the carrier member 3 is locked in the closed position by the locking bar 30. The lug 49 pivots the link member 46 as the carrier member 3 is just about to be locked by the locking bar 30, thereby activating the electric motor 28. This moves the roller slide member 16 across from the left-hand side to the right-hand side of the apparatus of FIG. 1, thus causing the roller 16 to bear with pressure on the document, and form the imprint thereon. When the roller slide block 15 has reached the right-hand side of the apparatus, the spud 43 depresses the trip pin 41, thereby releasing the locking bar 30, and in turn the carrier member 3 which springs open. The roller block 15 continues to return to the left-hand side of the apparatus, at which stage the trip release spud 43 trips the locking clip 50 which releases the link member 46 and deactivates the motor 28. Thus, the roller slide block 15 is ready for the next operation. Once the carrier member 3 has sprung open, the credit card and document are removed.

After some time when the ink roller 16 is exhausted of ink, the roller slide block 15 is replaced by a fresh one. This merely requires unclipping the roller slide block 15 from the tracks 18 and clipping a new block onto the tracks ensuring that the drive spud 23 is engaged in the slot 25 of the fresh roller block.

The invention has many advantages over devices known heretofore, and one of the important advantages is that by virtue of the drive mechanism, a relatively trouble free device is provided. Further, because of the construction of the drive arrangement a particularly compact apparatus is provided. Also, the device is considerably more silent than devices known heretofore.

Figures 9, 10:
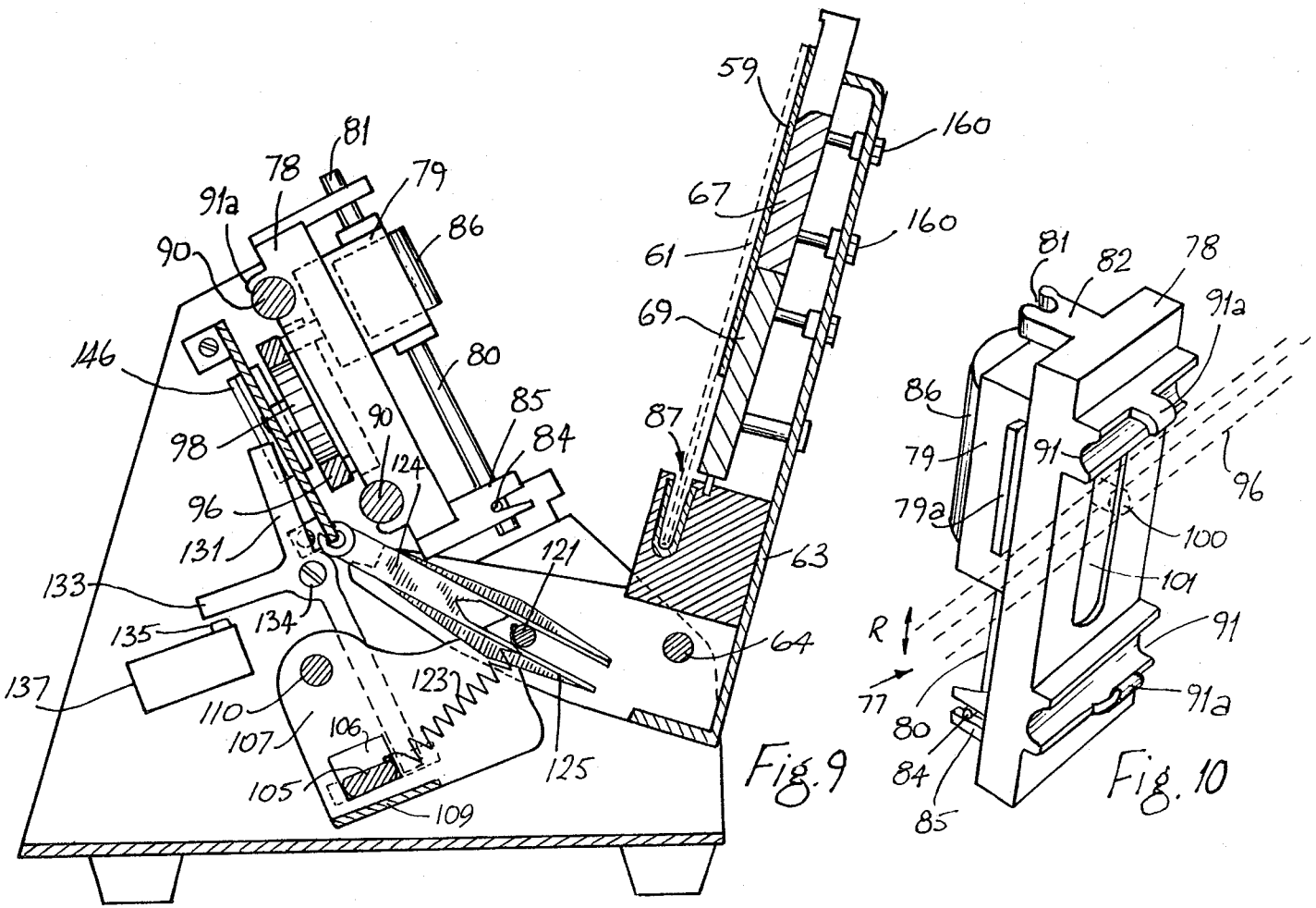
FIG. 9 is a cross-sectional view of the imprinter apparatus of FIG. 8.
FIG. 10 is a perspective view of portion of the apparatus of FIG. 8.
Figures 11, 12, 13:
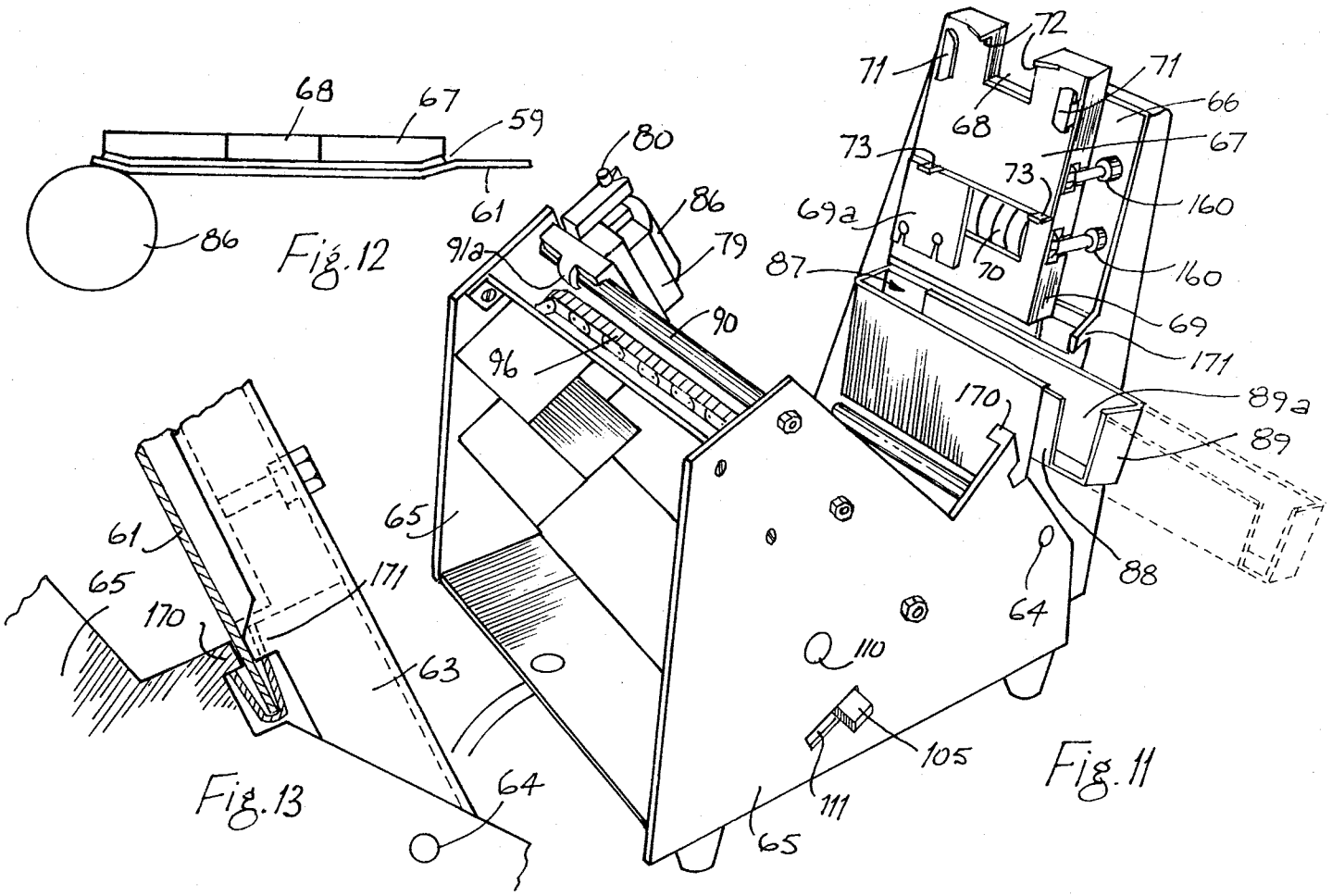
FIG. 11 is a perspective view, from the rear, of the apparatus of FIG. 8.
FIG. 12 is a plan view of a detail of the apparatus of FIG. 8.
FIG. 13 is a cross-sectional view of another detail of the apparatus of FIG. 8.
Figures 14, 16:
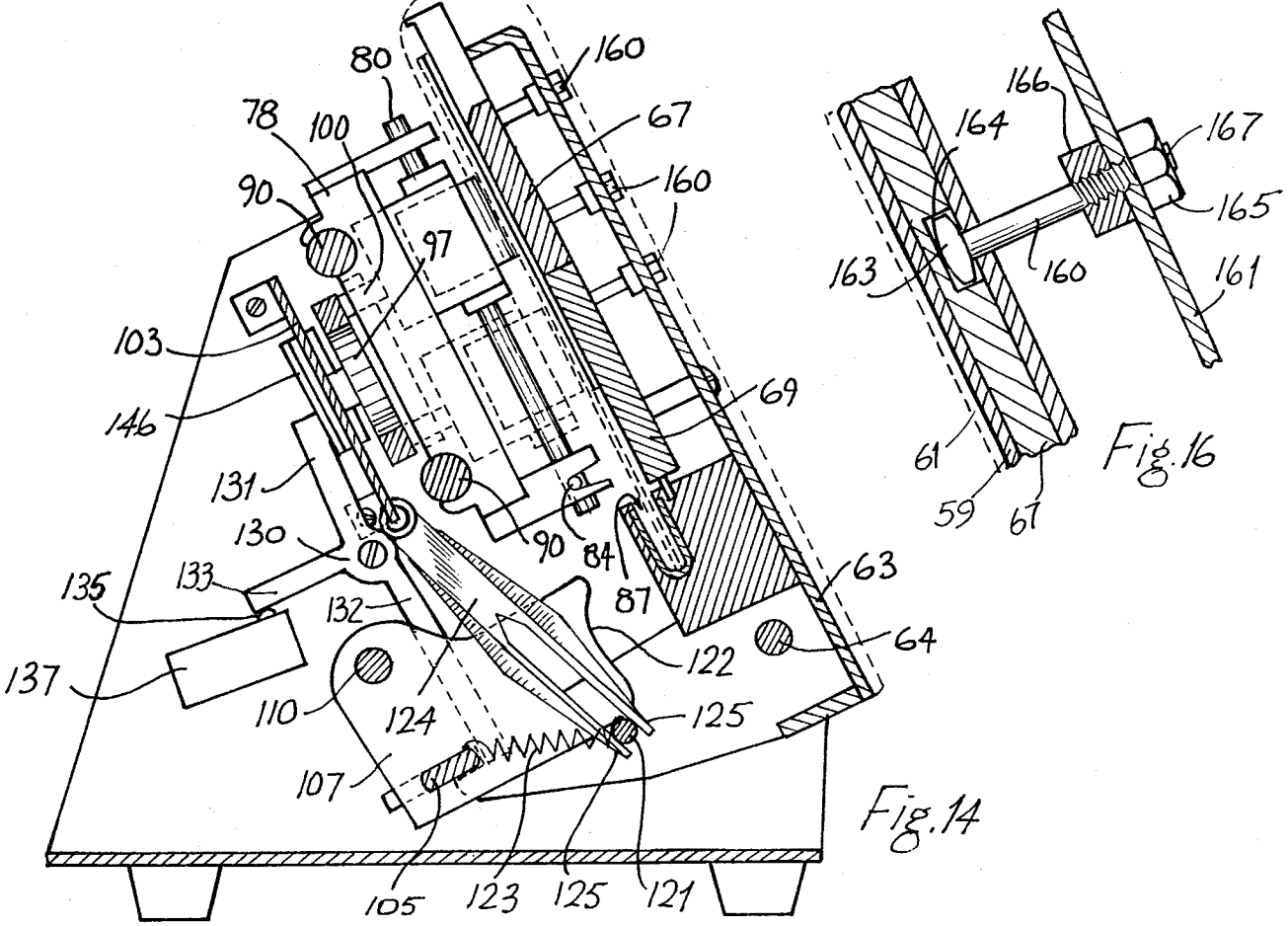
FIG. 14 is a cross-sectional view of the apparatus of FIG. 8 in a closed position.
FIG. 16 is a cross-sectional view of a detail of the apparatus of FIG. 8.

Referring to FIGS. 8 to 19 there is illustrated an imprinter apparatus according to another embodiment of the invention indicated generally by the reference numeral 60 for imprinting a character from a character imprint source member such as a credit card 59 onto an imprint recording sheet such as a document 61, which is illustrated in FIGS. 9, 13 and 14. The apparatus 60 comprises an imprinter means housing section 62. A means to receive the credit card 59 and document 61 is provided by a carrier member 63 pivotal on a pivot shaft 64 extending between side walls 65 of the housing 62. The carrier member 63 has a substantially flat surface 66 on which is mounted an upper credit card platen 67 to receive the credit card 59 and a lower merchants platen 69 carrying permanently mounted characters **69*a* which comprise the details of the merchant where the transaction is taking place. A date roller 70 is also provided which is snap fitted to a slot in the lower platen 69 by snap arms 70*a* (see FIG. 8). The upper platen 67 includes a central upper slot 68 for ease of insertion and withdrawal of a credit card 59. The card 59 is retained in position on the platen 67 in a pair of side clips 71 and by upper locating lugs 72 and lower lugs 73. For imprinting data from the merchants platen 69 and date roller 70 onto a cheque or the like a cheque is clipped into position under the lower side edges of the side clips 71. A pocket 87 for retaining the document 61 over the upper credit card platen 67, the merchans platen 69 and the date roller 70 is provided by a U-shaped plate member 88 having document retaining end walls 89. The plate members 88 is of telescopic construction as illustrated by interrupted lines in FIG. 11 for receiving standard short and long sized documents 61**.

It will be noted that one of the plate member 88 is cut-away at **89*a* to allow larger documents to be inserted into the pocket 87** if desired. This is sometimes required in the case where data has to be embossed onto a larger or additional documents, for example a hotel bill.

Figure 8:
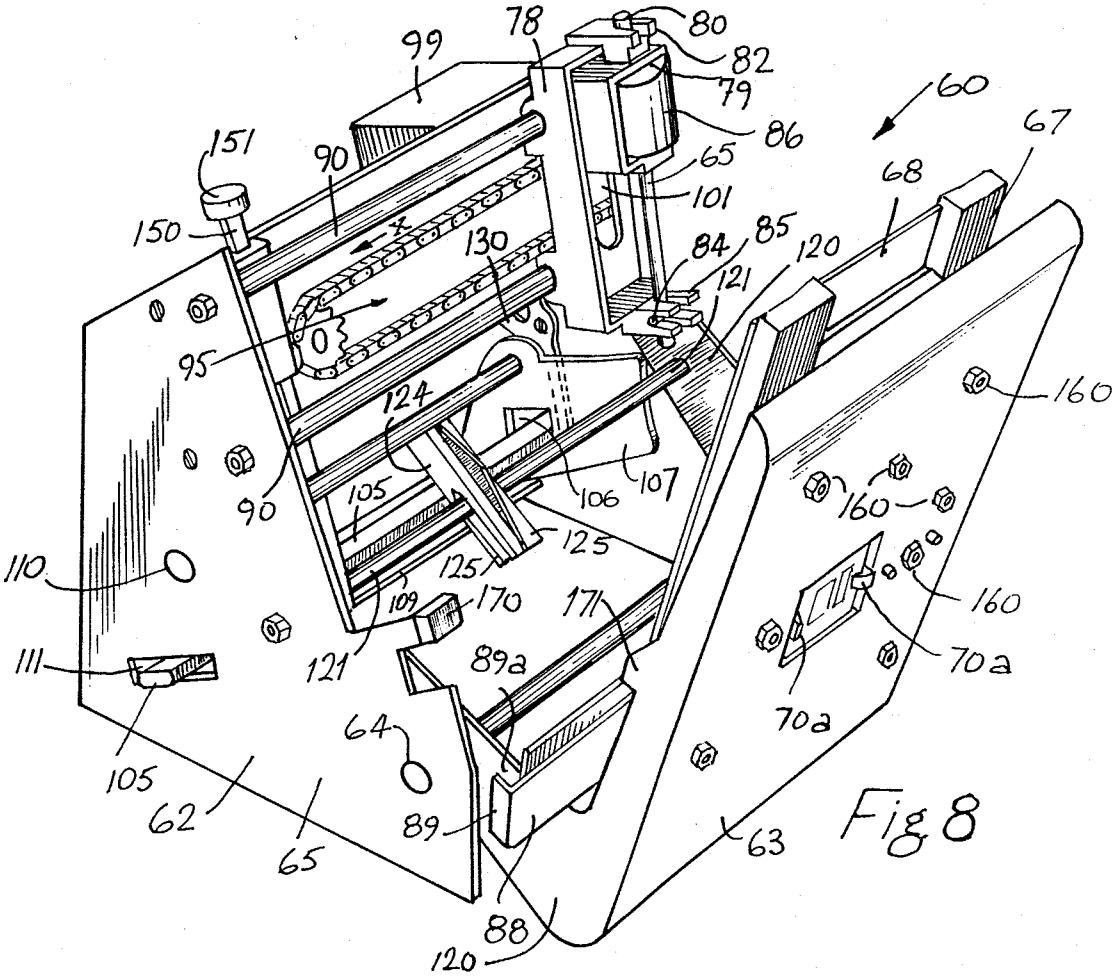
FIG. 8 is a perspective view of the imprinter apparatus according to another embodiment of the invention in an open position.
Figure 15:
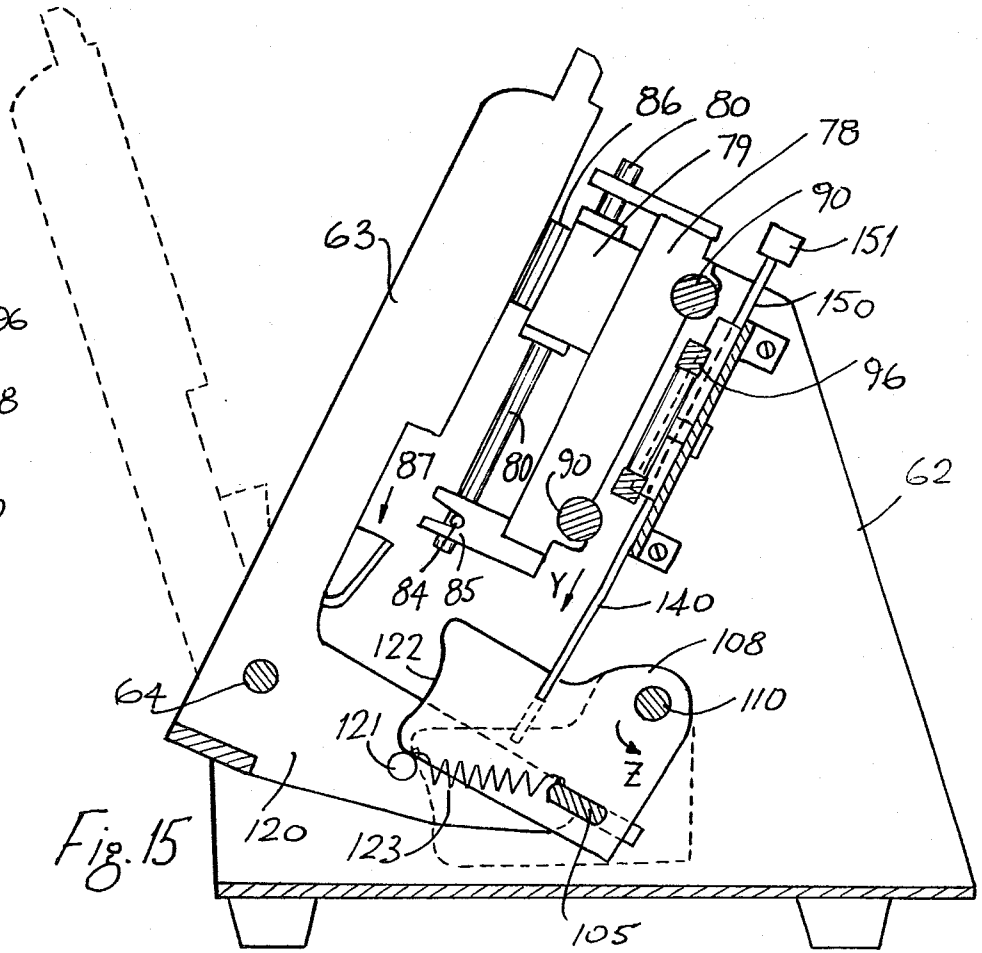
FIG. 15 is an end, partially cross-sectional view of the apparatus in a closed position.

The carrier member 63 is pivotal from an open position illustrated in FIGS. 8, 9 and 11 to a closed position illustrated in FIGS. 14 and 15 where the date on the credit card 59, merchants data and document 61 are brought into pressure contact with an imprint means comprising a roller means 77. The roller means 77 which is illustrated on an enlarged scale in FIG. 10 comprises a carrier block 78 and a releasable roller block 79 forming, in effect, a changeable roller cassette which may be removed from the carrier block 78 and replaced when desired. The roller block 79 is slidably mounted on a spindle 80 for movement in the direction of the arrows R between upper and lower imprinting positions and is releasably mounted at its upper end 81 in a forwardly projecting seat 82 provided on the carrier block 78 and at its lower end on a pivot pin 84 extending through the spindle 80 to engage a pair of lower seats 85 also provided on the carrier block 78. An inked roller 86 is rotatably mounted on the spindle 80 in the roller slide block 79. To change the roller 86, the spindle 80 is pivoted outwardly on the pivot pin 84 until the spindle 80 disengages from the upper seat 82 allowing the roller cassette comprising the block 79 and the roller 86 to be removed from the spindle 80 and a fresh cassette to be inserted. The roller block 79 is provided with a ridge **79*a* which defines, together with the adjacent side edge of the slide block a slot for receiving a coin or the like to lever the spindle 80 out of engagement with the upper seat 82. This has the advantage of 7allowing the roller cassette comprising the roller 86 and block 9 to be easily replaced when the ink is exhausted. Alternatively instead of a ridge the roller block 79** is provided with a slot for receiving a coin or the like.

The carrier block 78 is slidable on a pair of spaced-apart guide tracks comprising guide rods 90 of circular cross section extending between the side walls 65 of the housing 62. A pair of substantially semi-circular grooves 91 in the carrier slide block 78 are releasably engaged in the tracks 90. In this case the grooves 91 are provided with a pair of facing lugs 91A which together with the grooves 91 are greater than semi-circular in cross-section so that the lugs **91*a* engage the rods 90 with a slight snap-on action. This allows the carrier block 78 with the roller block 79 and roller 86 attached to be easily removed for maintenance. Alternatively the grooves 91 are slightly greater than semi-circular so that the grooves 91 engage the rods 90** with a snap-on action.

The carrier block 78 and hence the ink roller 86 is driven from one side, namely the right hand side of the apparatus of FIG. 8 to the left hand side, and returned again to the right hand side by a drive means which in this case comprises a chain drive mechanism, indicated generally by the reference numeral 95. On the pass from the right hand side to the left hand side the roller 86 bears on the document and credit card 59 and imprintng takes place, and on the return pass from the left hand side to the right hand side, the roller 86 bears on the document and merchants characters so that imprinting also takes place on the return pass. The particular advantage of this arrangement is that a more even print is obtained on the document.

It will be noted that the roller 86 is illustrated in the top half of FIG. 14 in a position for imprinting credit card characters onto a document and in the bottom half of FIG. 14 in a second position for imprinting merchants characters onto the document.

The chain drive mechanism 95 comprises a chain 96 mounted around a pair of sprockets namely a driven sprocket 97 which is driven by an electric motor 99 and an idler sprocket 98. The sprockets 99, 98 are mounted on a mounting plate 103. A first spud 100 on one link of the chain 96 engages the roller block 79 through an elongated slot 101 in the carrier block 78 as will be particularly apparent in FIG. 10. As the chain 96 moves in the direction of the arrow X in FIG. 8 from the right hand side to the left hand side with the spud 100 on the upper leg of the chain, the roller block 79 and hence the roller 86 is driven from the right to the left causing the credit card information to be imprinted on the document 61. As the spud 100 travels around the idler sprocket 98 the roller block 79 is pulled downwardly on the spindle 80 in the slide block 78 so that on the return pass of the chain 96 from the left hand side to the right hand side the roller 86 is in a position for imprinting the merchants data carried by the lower platen 69 onto the document 61.

The carrier 63 is retained in the closed position illustrated in FIGS. 14 and 15 by a lock means which in this case is provided by a locking bar 105 which is loosely mounted in slots 106 provided in a pair of spaced-apart side brackets 107, 108 which are interconnected by a cross member 109 and are fast on a pivot shaft 110. The locking bar 105 also extends through a pair of opposed slots 111 provide provided in the housing side walls 65. A pair of lock members 120 extending from the carrier 63 engage the brackets 107, 108 by a pair of inwardly projecting rod 121 which defines a latch formation and extends between the side walls 65 and engages against the front edges of the brackets 107, 108 in the open position illustrated in FIG. 8. It will be noted that the front edges of the brackets 107, 108 are shaped to form cam surfaces 122 on which the rods 121 acts in the open position to prevent the carrier 63 from travelling into the closed position under the biasing of a pair of coil springs 123 connected between the locking bar 105 and the rod 121. A damper which in this case comprises a peg 124 extends between the motor mounting plate 103 and the rod 121 to dampen the biasing action of the springs 123 when the carrier 63 moves between the closed and opened position. The peg 124 includes a pair of spaced-apart resilient forked legs 125 which frictionally engage the rod 121 to slow down the opening of the carrier 63.

As the carrier 63 is moved into the closed position, the rod 121 travels along the cam surfaces 122 and after a short inward movement of the carrier 63 the rod 121 disengages from the cam surface 122 allowing the carrier 63 to be pulled into the closed position illustrated in FIG. 14 under the biasing of the springs 123.

Figure 18:
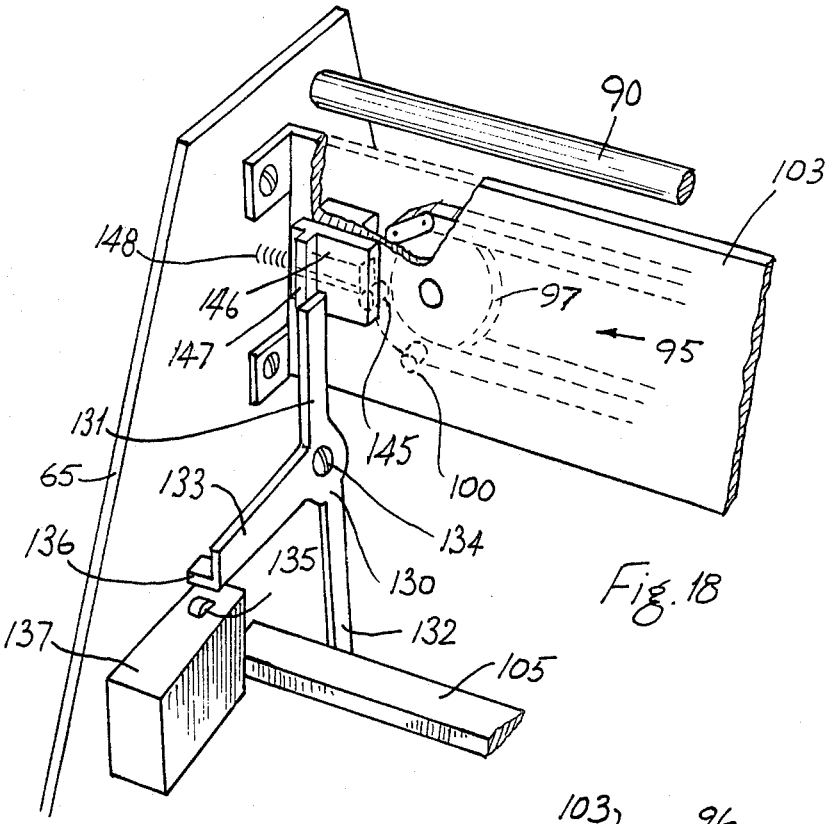
FIG. 18 is a perspective view of another detail of the apparatus.
Figure 19:
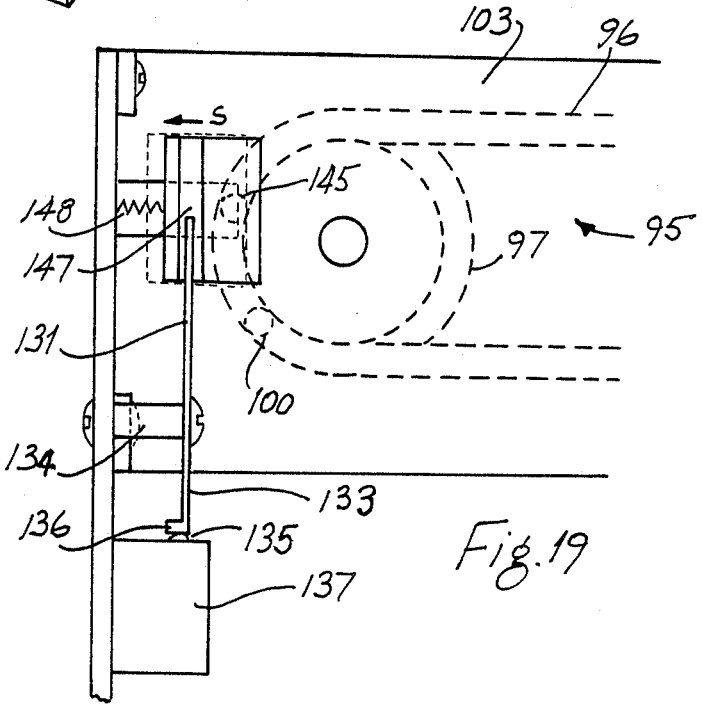
FIG. 19 is another view of the detail of FIG. 18.

Referring particularly to FIGS. 9, 14 and 18 switch operating means to operate the motor 99 in this case comprises a link member 130 having a three link arms, namely an upper link arm 131, a lower link arm 132 and a rearwardly extending mid-link arm 133. The link member 130 is pivotally mounted on a pivot pin 134 to a side wall 65 of the housing 62. The mid link arm 133 is formed with a lug 136 which bears on a plunger 135 of a microswitch 137 which controls the circuit which activates and de-activates the electric motor 99. As will be apparent from FIG. 18, the lower link arm 132 is engaged by the locking bar 105 and on closure of the carrier member 63 link arm 132 is pushed rearwardly about the pivot 134 thereby pressing the microswitch plunger 135 to activate the motor 99. Thus, on closure of the carrier 63 the motor 99 is activated and the roller 86 makes its first pass from the right hand side to the left hand side in FIG. 8.

Figure 17:
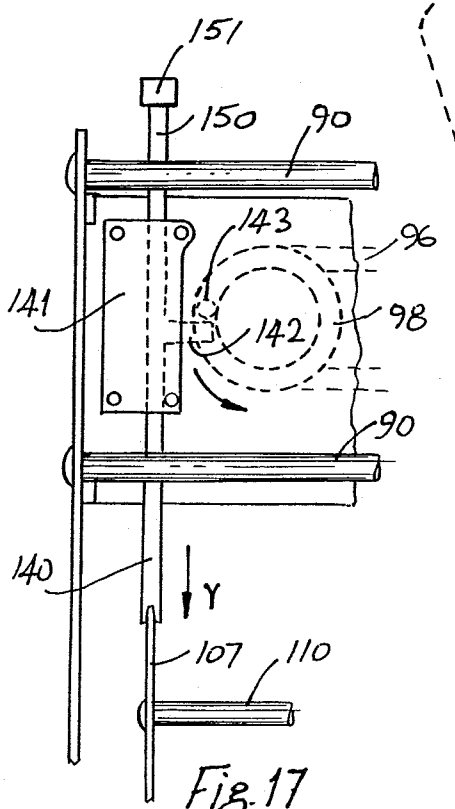
FIG. 17 is a partial view of a door-opening detail of the apparatus of FIG. 8.

A release means for releasing the brackets 107, 108 to allow the carrier member 63 to be opened when the imprinting procedure is finished is provided by a trip rod 140 the operation of which is most clearly illustrated in FIGS. 15 and 17. A block 141 is mounted on the trip rod 140 and includes a side-wardly extending trip arm 142. A trip release spud 143 on the rear of the chain 96 comes into engagement with the trip arm 142 as it passes around the idler sprocket 98 and thus depresses the arm 142 and hence moves the trip rod 140 downwardly in the direction of the arrow Y which in turn pivots the brackets 107, 108 in the direction of the arrow Z until the rod 121 engages the cam surfaces 122 of the brackets 107, 108 allowing the rod 121 to travel up the cam surfaces 122 to open the carrier 63. The trip release spud 143 engages the trip arm 142 when the roller 86 has moved from right to left and returned from left to right in FIG. 8.

A delay mechanism to prevent the motor 99 being switched off immediately the trip release spud 143 engages the arm 142 is activated by a motor cut-off spud 145 projecting from the rear of the chain 96. As will be particularly apparent from FIGS. 18 and 19 the motor cut-off spud 145 is positioned on the chain 96 at the opposite end to the trip release spud 143 so that the motor cut-off spud 145 engages a slide interposer block 146 as the trip release spud 143 is engaging the trip arm 142 of the trip lever 140. The slid interposer block 146 is slidable mounted to the mounting plate 103 and includes a rearwardly projecting ridge 147 on which the upper link arm 131 of the link member 130 rides when the trip release spud 143 engages the trip arm 142 of the trip lever 140 at the other end of the apparatus. In this position the lug 136 on the mid link arm 133 is still engaged with the microswitch plunger 135 through the action of the upper link arm 131 riding on the ridge 147. When the motor cut-off spud 145 on the chain 96 engages the slide interposer block 146 it pushes the block 146 sidewardly in the direction of the arrow S in FIG. 19 into the position illustrated in FIG. 18. The slide block 146 is pushed against the biasing of a spring 148, disengaging the upper link arm 131 from the ridge 147 and allowing the lug 136 of the mid link arm 133 to disengage from the microswitch plunger 135 to turn off the motor 99. This delay mechanism allows the motor 99 to continue running for a short period after the trip release spud 143 engages the trip arm 142 of the trip rod 140. Thus, the roller block is allowed to run on to its start position at the extreme right hand side of the apparatus as illustrated in FIG. 8, after the trip mechanism has been operated to open the carrier member 63.

An override release mechanism is also provided for releasing the carrier 63 in the event of the aparatus becoming jammed. In this case the override mechanism comprises an extension 150 on the trip lever 140 which extends through the housing 62 and terminated in a plunger button 151. In the event of a carrier 63 becoming jammed in the closed position the plunger button 151 is pressed downwardly to operate the trip rod 140 to release the cam rods 121 and hence allow the carrier 63 to be opened.

Means for independently adjusting the position of the upper and lower platens 67, 69 is provided by three adjusting screws 160 for each of the platens. Referring particularly to FIG. 16 each of the platens is screwed to a cover 161 and the head 163 of the adjusting screw 160 is housec in a recess 164 in the platen 67. The screw 160 threadingly engages a nut 165 provided on the cover 161 of the carrier 63. The head 163 of the screw 160 is dome-shaped and the recess 164 is oversized with respect to the dome head for adjusting the orientation of the platen. A lock nut 166 extends around the shank of the screw 160 and the screw is operated by engaging the head of a screwdriver or an allen key in a hole 167 provded in the free end of the screw 160. In use, the screws 160 allow the platens 67, 69 to be adjusted to facilitate good quality printing of characters from the credit card 59, merchants characters and date roller 70 on a document 61. Because the platens 67, 69 are independently adjustable and the roller imprints from a credit card onto the document and from the merchants card onto the document 61 in different passes the platens 67,69 can be finely adjusted to give even printing on the document 61.

Referring particularly to FIG. 12 it will be noted that the side edges of the platens 67, 69 are bevelled for pressure relief or clearance of the roller 85 when the carrier member 63 is closed at either end of the stroke.

Means for adjusting the number of documents which the imprinter will accept is in this case provided by a sensor arm 170 on one side of the wall 65 of the housing 62 and a corresponding sensor 171 on the carrier 63. As will be apparent from FIG. 13 the gap between the sensors 170 and 171 in the closed position is set to accommdate the thickness of a single document so that in the event of a second document being inserted the carrier 63 will not close and hence the imprinter loader will not operate. The desired thickness is set by slightly bending the sensor 170 using a pliers or the like.

In use, a credit card placed on the upper platen 67 with the carrier member 63 open. The document 61 is then placed in the pocket 87 overlying the credit card 59. The carrier member 63 is then closed and on closing is locked in the closed position by the locking bar 105. On closing, the lug 136 of the middle link arm 133 of the link member 130 engages the microswitch plunger 135 thereby activating the electric motor 99. This moves the carrier block 78 across from the right hand side to the left hand side of the apparatus of FIG. 8 thus causing the roller 86 to bear with pressure on the document 61 forming the imprint of the credit card thereon. When the carrier slide block 78 has reached the left hand side of the apparatus the drive stud 100 travelling around the idler sprocket 98 pulls the roller block 79 downwardly and on its return pass from the left hand side to the right hand side the roller 86 presses the document 61 against the merchants characters 69, 70 causing the merchaht imprint on the document. When the slide carrier block 78 has returned almost to the end of its travel on the right hand side the trip release spud 143 depresses the trip rod 140 however, the motor is not switched off immediately as the upper link arm 131 of the link member 130 rides of the ridge 147 of the slide block 146 keeping the microswitch plunger 135 closed. When the motor cut-off spud 145 engages the slide block 146 the block 146 is pushed sidewardly so that the upper arm 131 is disengaged from the ridge 147, releasing the mid link arm 133 from the microswitch plunger 135 and de-activating the motor. The locking bar 105 is also released, allowing the carrier members 63 to open. Thus, the carrier block 78 is in the position ready for the next operation. When the carrier member 63 is open the credit card and document is removed.

The motor may be a gear reduced brake motor which stops quickly when imprinting is complete. For ease of connection and disconnection the imprinter housing may be provided with a socket for connection to a main supply by a lead having a main plug at one end and an imprinter socket engaging plug at the other end.

It will of course be appreciated that while a particular shape and configuration of housing and carrier member has been described, any other suitable housing or carrier member could be provided. Further, it will be appreciated that other locking means besides that described for locking the carrier member in the closed position, could be provided, without departing from the scope of the invention. It will also of course be appreciated that other release means may be provided, and in certain cases it is envisaged that release means may be dispensed with altogether, and the carrier member could be released manually. It will be also appreciated that override release mechanisms could be dispensed with, and, instead of using an electric motor, a crank handle or the like could be used for traversing the roller blocks. Means other than those described for releasing the microswitch could be provided, and other means besides a cranked link member could be used for both activating and deactivating the microswitch.

While having a releasably mounted roller block has considerable advantages, it will of course be appreciated that the device could be provided with a non-releasable roller block. In certain cases, a roller merely mounted on a framework or a pair of spaced-apart brackets could be provided. Where it is desired to provide a releasable roller mechanism, it will be appreciated that other suitable constructions to release the roller could be provided. The ink roller may be mounted eccentrically so that by rotation of the eccentric mounting the pressure of the roller in use may be increased or decreased. Furthermore, it will be appreciated that while the apparatus has been described for imprinting embossed information on a credit card and onto a document, the apparatus could be used for imprinting any information onto any type of document or other sheet of material.

We claim:

1. Imprinter apparatus for imprinting characters from a character imprint source member onto imprint recording sheet material such as document sheets or the like, comprising an imprinter means housing section including a casing having movable roller means for transversely rectilinearly traversing a path laterally spanning an imprint station and drive means for moving said roller means back and forth along said path, the roller means including a horizontally slidable carrier block member and a changeable cassette carried thereby having a changeable vertically slidable roller block member and a vertically elongated generally cylindrical imprinter roller rotatably carried by said roller block member, the drive means comprising a pair of spaced-apart rotatable sprockets and an endless drive chain trained about said sprockets, the drive chain having a spud projecting therefrom, a pair of vertically spaced guide track members engaging and slidably supporting said carrier block member to guide the carrier block member and roller block member carried threby along said path, the carrier block member having a slot receiving said spud therein for driving the carrier block member and roller block member and roller carried thereby back and forth through advance and return strokes spanning said imprint station as the spud moves with said drive chain between said sprockets, said carrier block member having roller block support means movable from an operative position for imprinting document sheets to a release portion for removal and replacement of the roller block member and roller carried thereby, and a carrier member hinged for movement about a pivot axis to said housing section adjacent the path traversed by the roller means at said imprint station, said carrier member having a recess for receiving the imprint source member therein and a pocket formation for the recording sheet material, the carrier being movable about said pivot axis between an open position exposing said recess and pocket formation for introduction and withdrawal of the source member and sheet material and a closed position locating the sheet material and source member at said imprint station, said roller upon movement of said carrier block member and roller block member and its roller through said advance stroke by said spud and drive chain pressing the sheet material by said roller against said source member to produce a character imprint thereon.

2. Imprinter apparatus as defined in claim 1, wherein said guide track members are a pair of parallel circular cross-section rods and said slide block member is of a vertically elongated rectangular configuration having upper and lower end portions provided with slightly-greater-than-semi-circular recesses to snap-fit and slide on said rods.

3. Imprinter apparatus as defined in claim 2 including an electric drive motor coupled to one of said sprockets to drive the latter, switch means for activating said drive motor and switch operating means on said carrier member positioned to activate said switch means upon the carrier member reaching said closed position.

4. Imprinter apparatus as defined in claim 3, wherein said housing section includes a locking bar means and said carrier member includes locking arm means extending therefom having a latch formation to engage said locking bar means and latch the carrier member in closed position upon the latter reaching such closed position.

5. Imprinter apparatus as defined in claim 3, wherein said carrier block member has an elongated rod supported thereon having a pivoted lower end and an upper end releasably seated in a recess of a supporting arm extending from said carrier block member, said roller block member being slidably supported on said rod for movement between an upper imprint position and a lower imprint position and being removable from said rod upon withdrawal of said upper end from said recess and pivotable movement of the rod outwardly from said carrier block member for substitution of a replacement roller block member and roller carried thereby.

6. Imprinter apparatus as defined in claim 5, wherein said roller block member has an aperture receiving an end of said spud projecting through said slot of said carrier block member, said spud being disposed to locate said roller block member and roller at an upper position causing the roller to traverse a first upper imprinting path during movement of the spud and said carrier block member through said advance stroke and the roller block member being moved downwardly by said spud upon movement of its associated chain portion around the sprocket at the end of said advance stroke to a lower imprint position for movement traversing a lower imprint path during the return stroke of the spud to the other of said sprockets, and said carrier member having imprint source members aligned with both said upper imprint path and said lower imprint path.

7. Imprinter apparatus as defined in claim 2, wherein said housing section includes a locking bar means and said carrier member includes locking arm means extending therefrom having a latch formation to engage said locking bar means and latch the carrier member in closed position upon the latter reaching such closed position.

8. Imprinter apparatus as defined in claim 7, wherein said carrier block member has an elongated rod supported thereon having a pivoted lower end and an upper end releasably seated in a recess of a supporting arm extending from said carrier block member, said roller block member being slidably supported on said rod for movement between an upper imprint position and a lower imprint position and being removable from said rod upon withdrawal of said upper end from said recess and pivotable movement of the rod outwardly from said carrier block member for substitution of a replacement roller block member and roller carried thereby.

9. Imprinter apparatus as defined in claim 8, wherein said roller block member has an aperture receiving an end of said spud projecting through said slot of said carrier block member, said spud being disposed to locate said roller block member and roller at an upper position causing the roller to traverse a first upper imprinting path during movement of the spud and said carrier block member through said advance stroke and the roller block member being moved downwardly by said spud upon movement of its associated chain portion around the sprocket at the end of said advance stroke to a lower imprint position for movement traversing a lower imprint path during the return stroke of the spud to the other of said sprockets, and said carrier member having imprint source members aligned with both said upper imprint path and said lower imprint path.

10. Imprinter apparatus as defined in claim 2, wherein said carrier block member has an elongated rod supported thereon having a pivoted lower end and an upper end releasably seated in a recess of a supporting arm extending from said carrier block member, said roller block member being slidably supported on said rod for movement between an upper imprint position and a lower imprint position and being removable from said rod upon withdrawal of said upper end from said recess and pivotable movement of the rod outwardly from said carrier block member for substitution of a replacement roller block member and roller carried thereby.

11. Imprinter apparatus as defined in claim 10, wherein said roller block member has an aperture receiving an end of said spud projecting through said slot of said carrier block member, said spud being disposed to locate said roller block member and roller at an upper position causing the roller to traverse a first upper imprinting path during movement of the spud and said carrier block member through said advance stroke and the roller block member being moved downwardly by said spud upon movement of its associated chain portion around the sprocket at the end of said advance stroke to a lower imprint position for movement traversing a lower imprint path during the return stroke of the spud to the other of said sprockets, and said carrier member having imprint source members aligned with both said upper imprint path and said lower imprint path.

12. Imprinter apparatus as defined in claim 1 including an electric drive motor coupled to one of said sprockets to drive the latter, switch means for activating said drive motor and switch operating means on said carrier member positioned to activate said switch means upon the carrier member reaching said closed position.

13. Imprinter apparatus as defined in claim 12, wherein said housing section includes a locking bar means and said carrier member inlcudes locking arm means extending therefrom having a latch formation to engage said locking bar means and latch the carrier member in closed position upon the latter reaching such closed position.

14. Imprinter apparatus as defined in claim 12, wherein said carrier block member has an elongated rod supported thereon having a pivoted lower end and an upper end releasably seated in a recess of a supporting arm extending from said carrier block member, said roller block member being slidably supported on said rod for movement between an upper imprint position and a lower imprint position and being removable from said rod upon withdrawal of said upper end from said recess and pivotable movement of the rod outwardly from said carrier block member for substitution of a replacement roller block member and roller carried thereby.

15. Imprinter apparatus as defined in claim 14, wherein said roller block member has an aperture receiving an end of said spud projecting through said slot of said carrier block member, said spud being disposed to locate said roller block member and roller at an upper position causing the roller to traverse a first upper imprinting path during movement of the spud and said carrier block member through said advance stroke and the roller block member being moved downwardly by said spud upon movement of its associated chain portion around the sprocket at the end of said advance stroke to a lower imprint position for movement traversing a lower imprint path during the return stroke of the spud to the other of said sprockets, and said carrier member having imprint source members aligned with both said upper imprint path and said lower imprint path.

16. Imprinter apparatus as defined in claim 1, wherein said housing section includes a locking bar means and said carrier member includes locking arm means extending therefrom having a latch formation to engage said locking bar means and latch the carrier member in closed position upon the latter reaching such closed position.

17. Imprinter apparatus as defined in claim 16, wherein said carrier block member has an elongated rod supported thereon having a pivoted lower end and an upper end releasably seated in a recess of a supporting arm extending from said carrier block member, said roller block member being slidably supported on said rod for movement between an upper imprint position and a lower imprint position and being removable from said rod upon withdrawal of said upper end from said recess and pivotable movement of the rod outwardly from said carrier block member for substitution of a replacement roller block member and roller carried thereby.

18. Imprinter apparatus as defined in claim 17, wherein said roller block member has an aperture receiving an end of said spud projecting through said slot of said carrier block member, said spud being disposed to locate said roller block member and roller at an upper position causing the roller to traverse a first upper imprinting path during movement of the spud and said carrier block member being moved downwardly by said spud upon movement of its associated chain portion around the sprocket at the end of said advance stroke to a lower imprint position for movement traversing a lower imprint path during the return stroke of the spud to the other of said sprockets, and said carrier member having imprint source members aligned with both said upper imprint path and said lower imprint path.

19. Imprinter apparatus as defined in claim 1, wherein said carrier block member has an elongated rod supported thereon having a pivoted lower end and an upper end releasably seated in a recess of a supporting arm extending from said carrier block member, said roller block member being slidably supported on said rod for movement between an upper imprint position and a lower imprint position and being removable from said rod upon withdrawal of said upper end from said recess and pivotable movement of the rod outwardly from said carrier block member for substitution of a replacement roller block member and roller carried thereby.

20. Imprinter apparatus as defined in claim 19, wherein said roller block member has an aperture receiving an end of said spud projecting through said slot of said carrier block member, said spud being disposed to locate said roller block member and roller at an upper position causing the roller to traverse a first upper imprinting path during movement of the spud and said carrier block member through said advance stroke and the roller block member being moved downwardly by said spud upon movement of its associated chain portion around the sprocket at the end of said advance stroke to a lower imprint position for movement traversing a lower imprint path during the return stroke of the spud to the other of said sprockets and said carrier member having imprint source members aligned with both said upper imprint path and said lower imprint path.

* * * * *